United States Patent [19]

Harter

[11] Patent Number: 4,974,992

[45] Date of Patent: Dec. 4, 1990

[54] EXCAVATION CLOSURE

[76] Inventor: William M. Harter, 2028 E. Caroline La., Tempe, Ariz. 85284

[21] Appl. No.: 254,618

[22] Filed: Oct. 7, 1988

[51] Int. Cl.[5] ..... E02D 29/14

[52] U.S. Cl. ..... 404/25; 404/26; 52/20

[58] Field of Search ..... 404/25, 26; 49/463, 49/465, 460; 52/19, 20, 21; 16/110.5, 124, DIG. 24, 126, 127

[56] References Cited

U.S. PATENT DOCUMENTS

| | | | |
|---|---|---|---|
| 398,978 | 3/1889 | Scheer | 16/126 |
| 805,397 | 11/1905 | Wilhelm | 49/460 |
| 807,170 | 12/1905 | Holtzhouser | 16/126 |
| 815,983 | 3/1906 | Sherman | 16/126 |
| 958,550 | 5/1910 | Shepard | 49/460 |
| 1,110,194 | 9/1914 | Edey | 16/127 |
| 1,673,145 | 6/1928 | Gschwind | 404/26 |
| 1,803,337 | 5/1931 | Lundquist | 16/126 |
| 1,916,787 | 7/1933 | Elston | 404/9 |
| 2,697,244 | 12/1954 | Lincke | 16/126 |
| 3,920,347 | 11/1975 | Sauriol | 404/25 |
| 4,123,184 | 10/1978 | Whitlock | 404/25 |
| 4,189,804 | 2/1980 | Flowerday | 16/126 |
| 4,589,163 | 5/1986 | Weatherby | 16/124 |

FOREIGN PATENT DOCUMENTS

| | | | |
|---|---|---|---|
| 529826 | 11/1940 | United Kingdom | 404/25 |

*Primary Examiner*—Ramon S. Britts
*Assistant Examiner*—Gay Ann Spahn
*Attorney, Agent, or Firm*—Cahill, Sutton & Thomas

[57] ABSTRACT

A closure for excavations is provided, which comprises a plate which rests on and is supported by the edges of an excavation site. The upper surface of the plate is substantially flush with the surrounding street surface, and the plate has at least one lift opening. A bale handle is provided, wherein the bale handle is pivotally connected to the plate adjacent to the lift opening so that the bale handle can pivot 360° through the lift opening.

8 Claims, 1 Drawing Sheet

EXCAVATION CLOSURE

FIELD OF THE INVENTION

This invention relates to closures for street excavations which closures can be placed either over openings in the excavation or over ground.

DESCRIPTION OF THE PRIOR ART

Excavations of many kinds occur on streets. Often openings such as holes or trenches must be dug to provide access to underground utilities such as sewers, electric, gas or the like. When work is not being performed on the excavation, it is common to place large plates, commonly metal, over the excavations so that vehicular traffic can safely pass over the excavations. However, of necessity the plates must be sturdy and therefore heavy, which makes movement of the plates, either to open or close the excavations, a problem.

Early plates were moved by means of a hook and cable which could attach under plates by means of a keyhole in the plate. The plate could then be lifted by a crane. However, if the keyhole was over ground rather than over an opening in the excavation, it was difficult to insert the hook in the keyhole.

U.S. Pat. No. 4,123,184 to Whitlock discloses a plate with lifting handles which recess vertically into the plate when not in use, thereby protruding into the opening of an excavation. Therefore, as with the old "keyhole" type plates, the Whitlock plate is limited to placement over excavation openings rather than over ground because if the Whitlock plate's lift handles are placed over ground, they protrude upward above the surface of the street, which is unsafe for passage of vehicular traffic.

U.S. Pat. No. 3,920,347 to Sauriol discloses a lifting eye permanently placed on a plate in a recess which can be used to lift the plate by means of a hooked cable and crane. The lifting eye lies flush on the plate in the recess when not in use, and can be pivoted 90° into an upright position for insertion of the hooked cable when the plate must be moved.

However, both the Sauriol and Whitlock plates have additional and far more complicated features then is necessary for most excavation coverage, and consequently, these plates have limited applicability. Both plates can only be lifted by one side; that is, neither plate can be placed over an excavation "upside down". Therefore, greater care must be taken that the cable not swing either the Whitlock or Sauriol plate out of a "right-side up" position than would need to be taken if a plate could be placed over an excavation without regard to a proper orientation.

SUMMARY OF THE INVENTION

The present invention incorporates a closure for street excavations which includes a plate which may rest on and be supported by the edges of an excavation site. The upper surface of the plate is usually substantially flush with the surrounding street surface; the plate has at least one lift opening. A bale handle is provided, wherein the bale handle is pivotally connected to the lift opening so that the bale handle can pivot 360° through the lift opening.

It is a primary object of the present invention to provide an uncomplicated means for safe closure of excavations, regardless of whether the closure means lies directly over an opening or on the ground.

It is a further object of the present invention to provide an inexpensive means for closure of street excavations.

It is a still further object of the present invention that the closure means be able to be removed from the excavation regardless of the particular orientation of the closure on the excavation site.

Other objects, advantages and features of the present invention will become apparent from the following specification when taken in conjunction with the accompanying drawings.

DESCRIPTION OF THE PREFERRED EMBODIMENT

Figure 1:
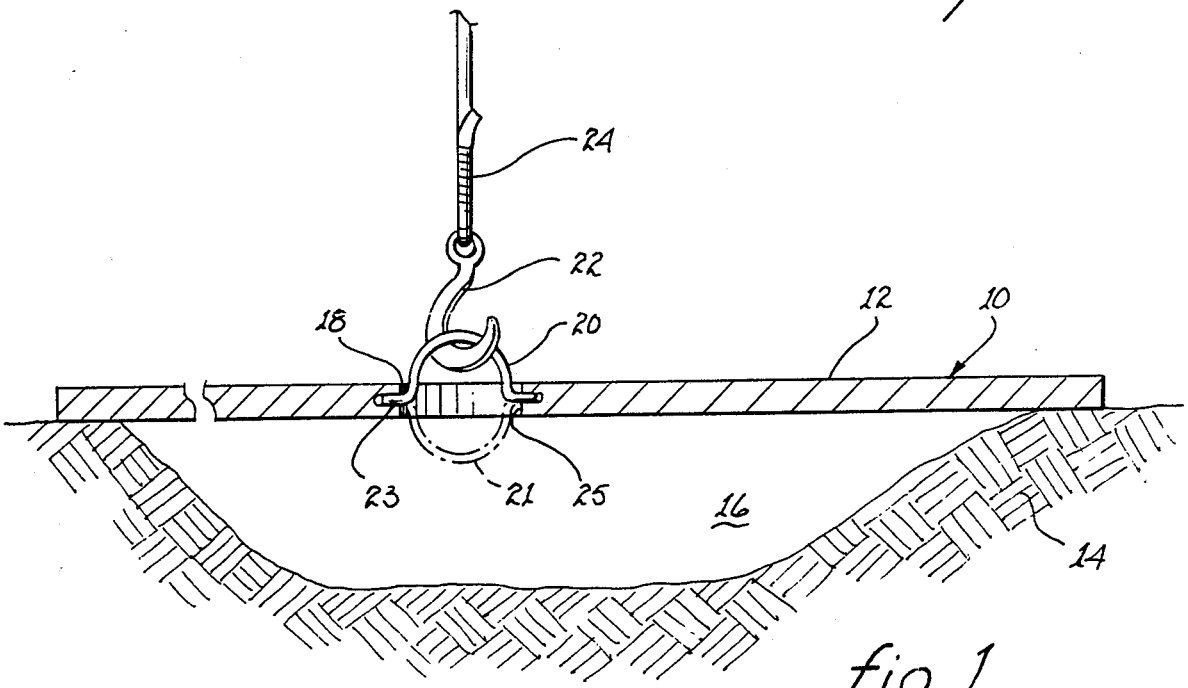
FIG. 1 is a cross-sectional view of the closure of the present invention applied over a primarily open street excavation.

FIG. 1 illustrates the closure of the street excavation according to the present invention. Referring to FIG. 1, the closure 10 comprises a plate 12 which can be placed essentially flush over excavation 14 which may include a hole 16. The plate 12 contains at least one lift opening such as the lift opening 18. A bale handle 20 is provided, and is pivotally secured to the plate 12 adjacent to lift opening 18 so that the bale handle 20 can pivot 360° through the lift opening 18. While the above description relates to a plate having a single bale handle, it will be understood by those skilled in the art that most conventional plates used in present excavation sites will incorporate at least two lift openings and bale handles. Each lift opening and bale handle would be the same as that described above.

When the bale handle 20 is pivoted so as to be at right angles to the plate 12 as shown in FIG. 1, a hook 22 attached to a cable 24 can engage the bale handle 20 and thereby lift the plate 12 from the excavation 14 by any convenient means such as a crane (not shown). When the plate 12 is not being moved, the bale handle 20 can pivot downward through the lift opening 18 in either direction, clockwise or counterclockwise, thereby describing a 360° circle. If the plate 12 is essentially over a hole 16, the bale handle 20 will extend freely into the hole 16 as shown in broken lines at 21 in FIG. 1. The bale handle ends 23 extend into the walls 25 of the lift opening 18 to provide a substantially flat plate surface when the bale handles 20 are not being used.

If one lift opening 18 and bale handle 20 are used, they should be placed essentially at the center of the plate 12. If more lift openings and corresponding bale handles are used, they should be placed symmetrically so that hook cables engaging the bale handles for movement of the plate 12 can bear the weight of the plate evenly, preventing unexpected and potentially hazardous shifting of the plate during movement by the crane.

Figure 2:
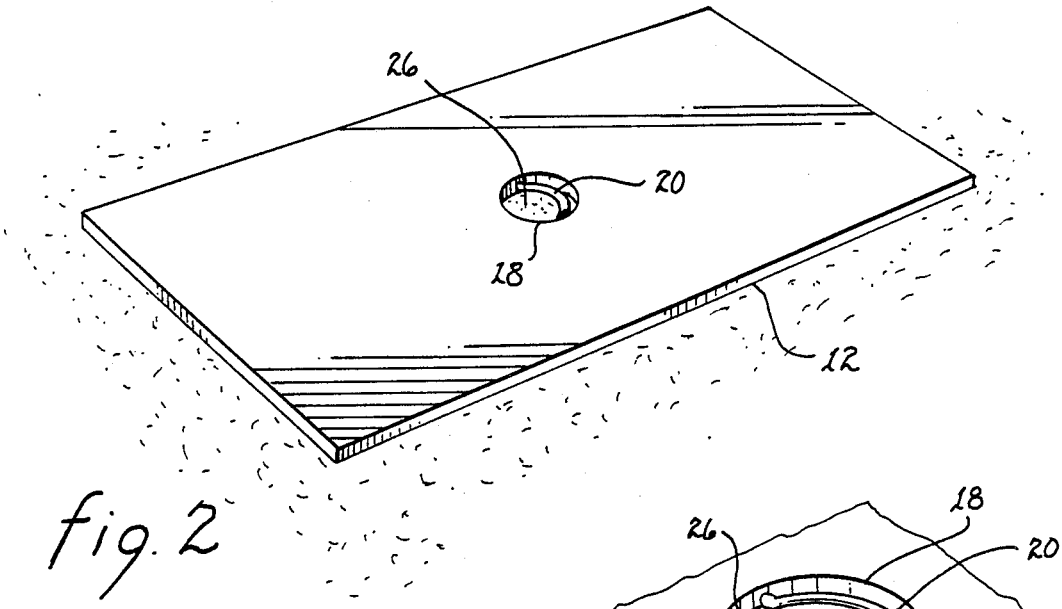
FIG. 2 is a perspective view of the closure of the present invention lying on the ground.
Figure 2A:
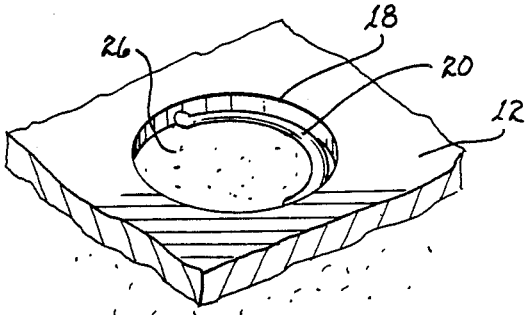
FIG. 2*a* is a close-up cross-sectional view of a bale handle connected to a plate adjacent to a lift opening as shown in FIG. 2.

As shown in FIG. 2 and more particularly, in FIG. 2*a*, if the plate 12 is lying over essentially flat ground 26 rather than over a hole 16 as pictured in FIG. 1, the bale handles 20 will lie flat on the ground 26 within the recessed lift opening 18 when not in use, rather than extending freely underneath the plate 12 as described above. Both the plate 12 and bale handles 20 can be made of any sturdy material which can safely bear vehicular traffic, although metal is preferred.

As is obvious by the uncomplicated nature of the closure 10 and the fact that the bale handles 20 can freely pivot 360° through the lift opening 18, the plate 12 has no "right or wrong" side; either side of the plate 12 can be placed over an excavation, which considerably simplifies movement of such plates on or off excavation sites. Further, it is apparent that the bale handles can conveniently provide a means for lifting the plate even though the plate is not over a hole; the hook may engage the bale handles without regard to what is positioned beneath the plate.

It is to be understood that the present invention is not limited to the particular construction and arrangement of parts disclosed and illustrated herein but embraces all such modified forms thereof which are within the scope of the following claims.

What is claimed is:

1. A closure for excavations comprising:

(a) a substantially planar plate which rests on and is supported by edges of an excavation site, with the upper surface of the plate substantially flush with a surrounding street surface;

(b) means forming a lift through opening in said plate;

(c) a bale handle rotatably connected to said plate within said lift through opening and being freely rotatable throughout 360° therein about an axis which lies within a plane of said plate, the thickness of said bale handle being less than that of said plate whereby said plate may be raised by connection to said bale handle when said bale handle is pivoted to extend at a substantially right angle to said plate.

2. The closure of claim 1 wherein the plate and bale handles are metal.

3. A closure for excavations comprising:

(a) a substantially planar plate which rests on and is supported by the edges of the excavation site, with the upper surface of the plate substantially flush with the surrounding street surface;

(b) means forming a plurality of lift through openings arranged symmetrically on said plate;

(c) a corresponding plurality of bale handles rotatably connected to said plate within said lift through openings; and being freely rotatable throughout 360° therein about an axis which lies within a plane of said plate, the thickness of said bale handles being less than that of said plate whereby said plate may be raised by connection to said bale handles when said bale handles are pivoted to extend at a substantially right angle to said plate.

4. The closure of claim 3 wherein the plate and bale handles are metal.

5. A closure for excavations comprising:

(a) a substantially planar plate which rests on and is supported by the edges of the excavation site, with the upper surface of the plate substantially flush with the surrounding street surface;

(b) means forming a lift through opening on said plate;

(c) a bale handle having two ends wherein the ends partially extend into opposing walls of said lift through opening and are freely rotatable throughout 360° therein about an axis which lies within a plane of said plate, the thickness of said bale handle being less than that of said plate to provide a substantially flush plate surface when the bale handles are not in use;

whereby said plate may be raised by connection to said bale handle when said bale handle is pivoted to extend at a substantially right angle to said plate.

6. The closure of claim 5 wherein the plate and bale handles are metal.

7. A closure for excavations comprising:

(a) a substantially planar plate which rests on and is supported by the edges of the excavation site, with the upper surface of the plate substantially flush with the surrounding street surface;

(b) means forming a plurality of the lift through openings arranged symmetrically on said plate;

(c) a corresponding plurality of bale handles having two ends wherein the ends partially extend into opposing walls of said lift openings and are freely rotatable through 360° therein about an axis which lies within a plane of said plate, the thickness of said bale handles being less than that of said plate to provide a substantially flush plate surface when the bale handles are not in use;

whereby said plate may be raised by connection to said bale handles when said bale handles are is pivoted to extend at a substantially right angle to said plate.

8. The closure of claim 7 wherein the plate and bale handles are metal.

* * * * *